US008430253B1

(12) United States Patent
Jackson et al.

(10) Patent No.: US 8,430,253 B1
(45) Date of Patent: Apr. 30, 2013

(54) ATTACHABLE, ADJUSTABLE RETAINER FOR SHELVES

(76) Inventors: William L. Jackson, Livingston, MT (US); Sandra C. Jackson, Livingston, MT (US)

( * ) Notice: Subject to any disclaimer, the term of this patent is extended or adjusted under 35 U.S.C. 154(b) by 191 days.

(21) Appl. No.: 12/881,581

(22) Filed: Sep. 14, 2010

(51) Int. Cl.
*A47F 5/08* (2006.01)
*A47F 5/00* (2006.01)

(52) U.S. Cl.
USPC ..... 211/90.03; 211/175; 211/106

(58) Field of Classification Search ..... 211/175, 211/184, 43, 181.1, 90.01–90.04, 193, 75, 211/106, 106.1, 87.01, 86.01; 108/42; 312/245
See application file for complete search history.

(56) References Cited

U.S. PATENT DOCUMENTS

| | | | | | |
|---|---|---|---|---|---|
| 831,205 | A | * | 9/1906 | Barnard | 248/311.2 |
| 1,136,331 | A | * | 4/1915 | Harding | 211/106 |
| 1,555,904 | A | * | 10/1925 | Brunson | 211/35 |
| 1,741,928 | A | * | 12/1929 | Gafney | 211/106 |
| 1,936,517 | A | * | 11/1933 | Maine | 62/466 |
| 2,074,438 | A | * | 3/1937 | Swedman | 220/480 |
| 2,230,975 | A | * | 2/1941 | Gratz | 312/248 |
| 3,094,217 | A | * | 6/1963 | Peterson | 211/50 |
| 3,851,765 | A | | 12/1974 | Cox | |
| 3,938,872 | A | | 2/1976 | Hagerman | |
| 4,109,797 | A | * | 8/1978 | Brunette | 211/133.5 |
| 4,118,087 | A | | 10/1978 | Dorf | |
| 4,437,572 | A | | 3/1984 | Hoffman | |
| 4,813,535 | A | * | 3/1989 | Radocha et al. | 206/738 |
| 4,840,279 | A | * | 6/1989 | Cobb et al. | 211/88.01 |
| 4,936,467 | A | * | 6/1990 | Bobeczko | 211/14 |
| 5,096,272 | A | * | 3/1992 | Belokin et al. | 312/129 |
| 5,100,008 | A | * | 3/1992 | O'Herron | 211/106 |
| 5,228,578 | A | * | 7/1993 | Wu | 211/43 |
| 5,460,279 | A | * | 10/1995 | Emery et al. | 211/106 |
| 5,513,910 | A | * | 5/1996 | Ellingwood et al. | 312/405.1 |
| 5,520,118 | A | * | 5/1996 | McCarthy | 108/42 |
| 5,601,198 | A | | 2/1997 | Reed | |
| 5,875,902 | A | * | 3/1999 | Emery et al. | 211/90.03 |
| 5,894,940 | A | * | 4/1999 | Gusdorf et al. | 211/35 |
| 5,921,410 | A | * | 7/1999 | Emery et al. | 211/88.01 |
| 6,109,462 | A | * | 8/2000 | Emalfarb et al. | 211/119 |
| 6,341,704 | B1 | * | 1/2002 | Michel, Jr. | 211/181.1 |
| 7,249,679 | B2 | * | 7/2007 | Klein | 211/37 |
| 7,806,283 | B2 | * | 10/2010 | Metcalf | 211/175 |
| 2002/0163218 | A1 | | 11/2002 | Stubbings et al. | |
| 2004/0245200 | A1 | * | 12/2004 | Jersey et al. | 211/189 |
| 2004/0262247 | A1 | * | 12/2004 | Moon | 211/74 |
| 2007/0138116 | A1 | * | 6/2007 | Metcalf | 211/90.01 |
| 2008/0035591 | A1 | * | 2/2008 | McLaughlin et al. | 211/85.31 |

* cited by examiner

*Primary Examiner* — Jennifer E. Novosad
(74) *Attorney, Agent, or Firm* — Montgomery Patent & Design; Robert C. Montgomery

(57) ABSTRACT

An attachable, adjustable railing device for shelves comprises a plurality of horizontal rails, a plurality of vertical braces, and a structure to fasten to a shelf. The rails are "L"-shaped being joined along a front edge portion by a telescoping insertable connection for adjusting an overall width of the device. The rails further comprise fasteners affixed to side portions which attach to corresponding fasteners attached to adjacent surfaces of cabinets, cupboards, walls, or other adjacent structures.

13 Claims, 4 Drawing Sheets

ATTACHABLE, ADJUSTABLE RETAINER FOR SHELVES

RELATED APPLICATIONS

The present invention was first described in a notarized Official Record of Invention on Dec. 28, 2009, that is on file at the offices of Montgomery Patent and Design, LLC, the entire disclosures of which are incorporated herein by reference.

FIELD OF THE INVENTION

The present invention relates generally to retainers for shelving, and in particular, to an attachable and width adjustable retainer for shelves.

BACKGROUND OF THE INVENTION

Millions of Americans enjoy camping and traveling as their preferred leisure time activity. Among avid campers, many choose to do so in recreational vehicles that range in size from small pop-up campers that are designed to be towed behind a car or truck to large motorized recreational vehicles (RV's) with integral engines. These RV's provide all the comforts of home, including a multitude of storage cabinets and cupboards to hold food, materials, and supplies. Unfortunately, the contents of such cabinets tend to move and slide about as the RV travels down the road or during stops. In instances of rough roads it is not uncommon to have one of these cabinet doors accidentally open, causing the contents to spill out upon the floor of the RV. Should such materials be made of glass or other fragile materials, breakage can happen and require a large amount of cleanup. Even if such cabinet doors do not open on their own, many RV occupants have been surprised when opening a cabinet at a later time and having the contents fall out upon them.

While various shelf retainers and barriers have attempted to provide a way to selectively retain, hold, or otherwise support shelved items, none have been suitable for use to solve these problems. Examples of these attemtps can be seen by reference in several U.S. Patents. U.S. Pat. No. 3,938,872, issued in the name of Hagerman, discloses a shelf retainer for mobile vehicle refrigerators. U.S. Pat. No. 4,118,087, issued in the name of Dorf, discloses recreational vehicle shelf bars. U.S. Pat. No. 4,437,572, issued in the name of Hoffman, discloses a shelf retainer. U.S. Pat. No. 5,601,198, issued in the name of Reed, discloses a flexible barrier for a shelf.

While these devices may accomplish their specific intended purpose, each suffers from one (1) or more disadvantage or deficiency with respect to design, function, or effectiveness. In particular, these attempts do not provide an effective method of adjusting the width of the retainer in order for the device to be used on various types and sizes of cabinets or cupboards. Additionally, these attempts typically do not allow a user to conveniently access those shelved items without removing the retainer and also may interfere with proper operation of the cabinet or cupboard doors.

Accordingly, there exists a need for a means by which items inside of cabinets located in recreational vehicles can be safely and securely stored without the disadvantages as described above. The development of the present invention substantially departs from the conventional solutions and in doing so fulfills this need.

SUMMARY OF THE INVENTION

In view of the foregoing references, the inventor recognized the aforementioned inherent problems and lack in the art and observed that there is a need for a device which provides a simple and effective way to retain and secure various times commonly stored within cabinets or cupboards, particularly those found in recreational vehicles. Thus, the object of the present invention is to solve the aforementioned disadvantages and provide for this need.

Another object of the present invention is to provide a device which prevents the various shelved items from falling from the cabinet or cupboard.

Yet another object of the present invention is to provide a device which allows access to the various shelved items when desired.

Yet another object of the present invention is to provide a device which is simple and time effective to install and remove.

Yet another object of the present invention is to provide a device which is does not interfere with the operation of the cabinet or cupboard door.

Yet still another object of the present invention is to provide a device which is simple and intuitive to use with little to no training.

Yet still another object of the present invention is to provide a device which is durable and economical to manufacture.

One (1) or more of these and other objects of the invention are achieved by providing an adjustable retaining device for shelving comprising a first rail section including at least two (2) elongated tubular members, a second rail section including at least two (2) elongated tubular members, a plurality of flat generally "L"-shaped braces, and a removable fastener for installing the device within the storage compartment of the cabinet or cupboard. Each tubular member of the first rail section includes a receiving end, a terminating end, and a generally ninety degree (90°) intermediate bend. Each tubular member of the second rail section includes an insertable end, a terminating end, and a generally ninety degree (90°) intermediate bend. Each of the second rail tubular member insertable ends are insertably connected to each of the first rail tubular member receiving ends, providing a width adjustable, telescoping connection. The braces include a vertical leg oriented across the tubular members to retain the shelved items and a horizontal leg extending inwardly from the tubular members to provide support to the device.

Furthermore, the described features and advantages of the invention may be combined in various manners and embodiments as one skilled in the relevant art will recognize. The invention can be practiced without one or more of the features and advantages described in a particular embodiment.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Figure 1:
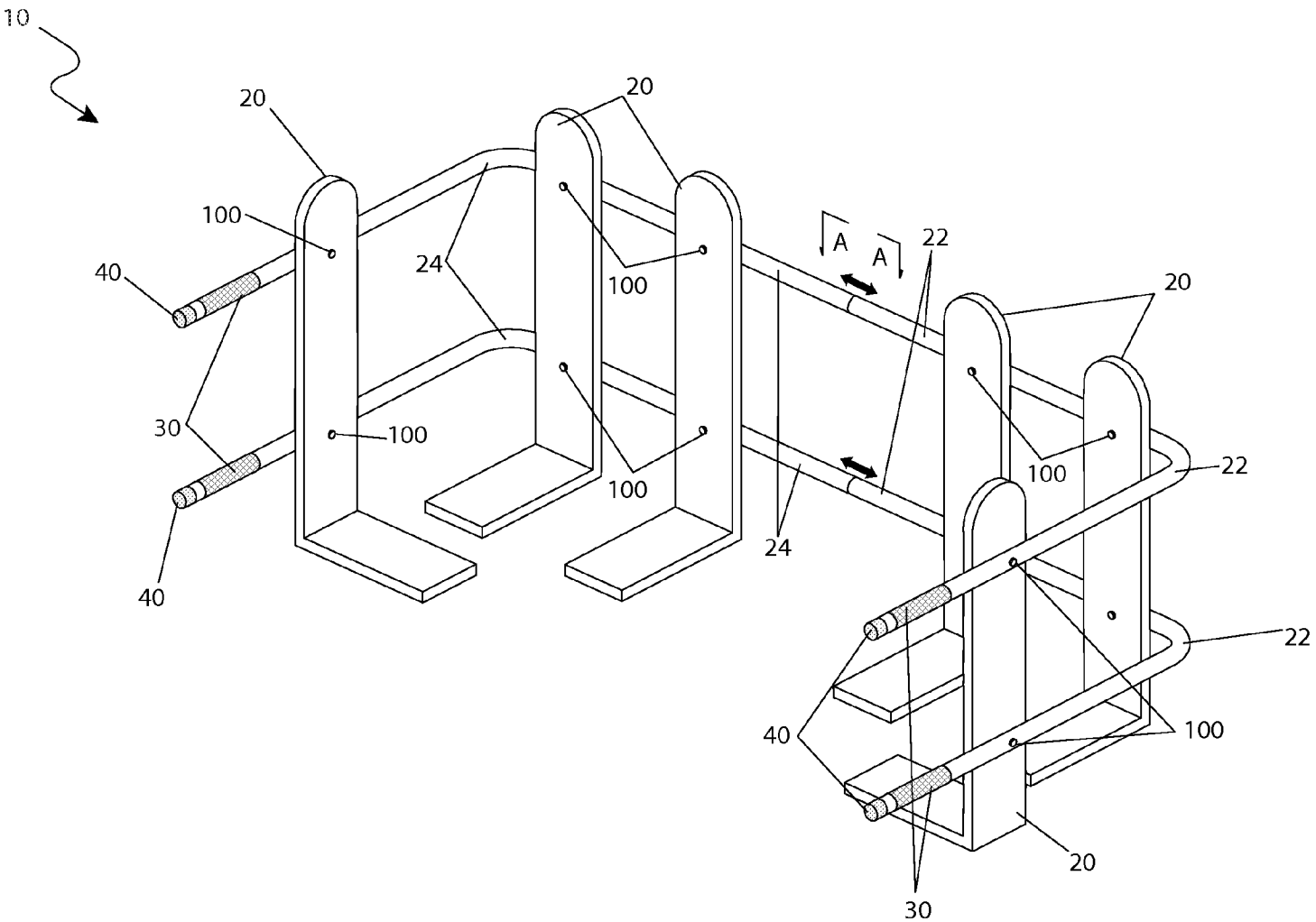
FIG. 1 is a perspective view of an adjustable retainer for shelves 10, according to a preferred embodiment of the present invention.

| DESCRIPTIVE KEY | |
|---|---|
| 10 | adjustable retainer for shelves |
| 20 | vertical retaining brace |
| 22 | first tubular rail |
| 23 | female tubular feature |
| 24 | second tubular rail |
| 25 | male tubular feature |
| 30 | tubular fastener |
| 35 | receiving fastener |
| 40 | end cap |
| 42 | hollow end portion |
| 100 | brace fastener |
| 110 | items |
| 150 | cupboard |
| 160 | cupboard floor |

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an adjustable retainer for shelves (herein described as the "device") 10, which comprises a plurality of vertical retaining braces 20, a pair of first tubular rails 22, a pair of second tubular rails 24, and a plurality of tubular fasteners 30.

Referring now to FIG. 1, a perspective view of the device 10, according to a preferred embodiment of the present invention, is disclosed. Each of the vertical retaining braces 20 comprises a flat "L"-shaped structure having a bottom leg portion which extends inwardly to a central space and are envisioned to be constructed of durable, lightweight materials such as plastic, wood, or metal. The vertical retaining braces 20 are held in vertical position and in a parallel orientation with regards to each other by the pair of first tubular rails 22 and the pair of second tubular rails 24, which are arranged in horizontal upper and lower parallel positions and are affixed to the vertical retaining braces 20 using brace fastenings 100 such as rivets, screws, or the like. The first 22 and second 24 tubular rails comprise hollow round tubes forming a general "L"-shape and having a rounded corner portion. Additionally, the first 22 and second 24 tubular rails provide a telescopingly connected to each other at an intermediate location of the device 10, thereby providing a means to vary an overall width of the device 10 based upon a particular cupboard 150 into which the device 10 is to be installed (see FIGS. 2 and 3).

The tubular fasteners 35 are affixed to each rail 22, 24 being adjacent to an end portion of the rail 22, 24 and being positioned opposite the aforementioned intermediate joining portion. The tubular fasteners 30 are to be wrapped around respective rail portions 22, 24 in a cylindrical manner and bonded preferably using an industrial adhesive or equivalent bonding technique. During installation of the device 10 into a cupboard 150 or similar storage area, the tubular fasteners 30 are adjoined to corresponding pre-installed receiving fasteners 35 having been affixed to an inner surface of the cupboard 150. The communicating fasteners 30, 35 securing the device 10 at a desired position along a front opening of the cupboard 150 (see FIG. 2). The tubular fasteners 30 and corresponding receiving fasteners 35 are preferably hook-and-loop-type fasteners. The receiving fasteners 35 are preferably mounted to an interior vertical wall surface of the cupboard 150 at a selected location to mate with the tubular fasteners 30 by use of adhesives.

The device 10 is depicted here having three (3) vertical retaining braces 20 affixed to each tubular rail 22, 24; however, it is understood that an actual number of vertical retaining braces 20 as well as the actual width of the tubular rails 22, 24 may vary with respect to a cupboard 150 having a particular width in which the device 10 is installed and as such should not be interpreted as a limiting factor of the device 10.

Figure 2:
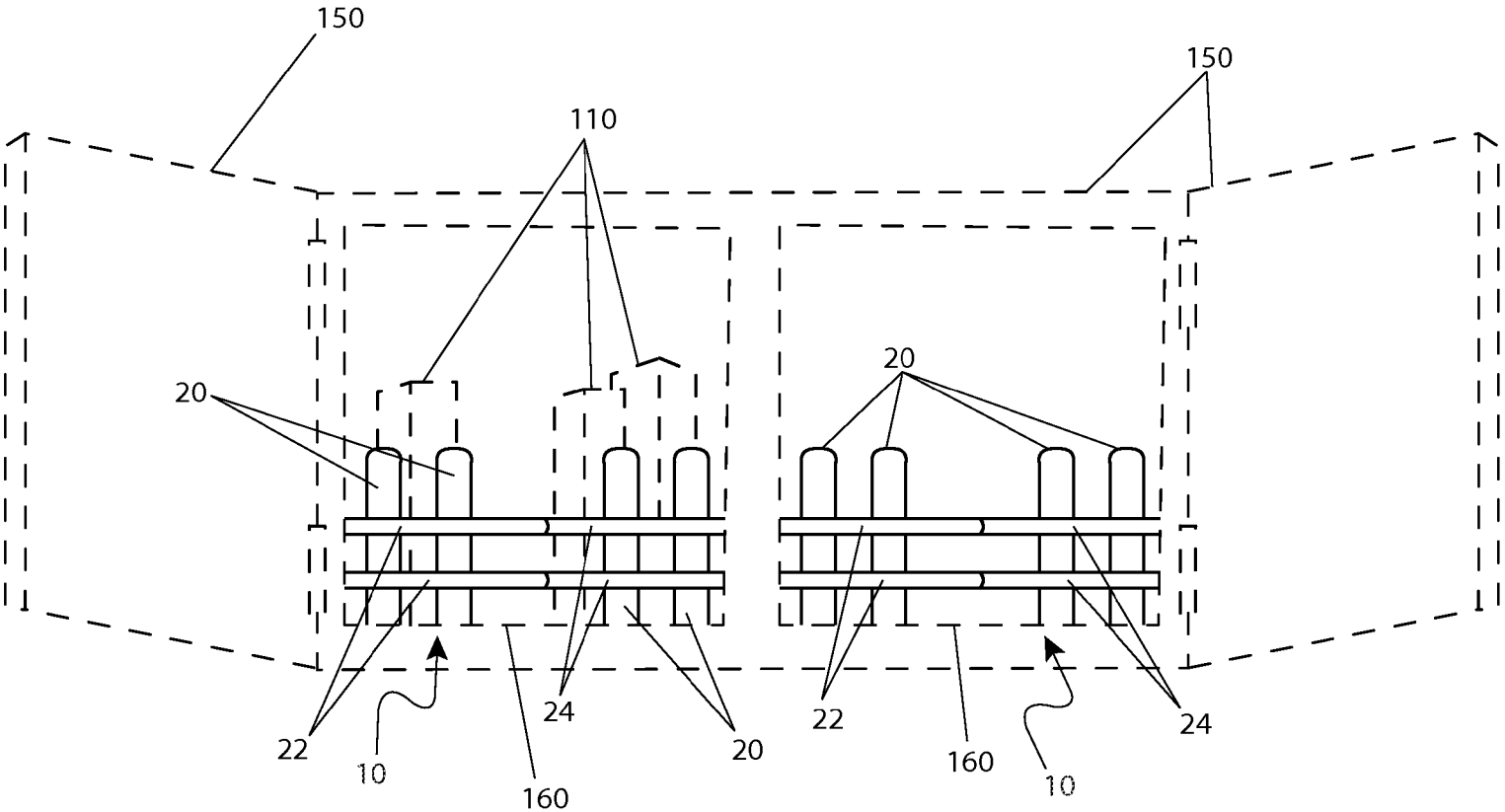
FIG. 2 is an environmental view of the adjustable retainer for shelves 10 depicting installation within a cupboard 150, according to a preferred embodiment of the present invention.

Referring now to FIG. 2, an environmental view of the device 10 depicting installation within the cupboard 150, according to a preferred embodiment of the present invention, is disclosed. The device 10 provides containment and stability to various items 110 which are typically loaded into and stored within cupboards 150. Items 110, such as food stuffs, personal care stuffs, and the like are placed and stored upon a cupboard floor portion 160, or similar storage compartment. Particularly related to cabinets and cupboards 150 used in recreational vehicles, these items 110 have a tendency to shift or fall when the vehicle is in motion or stops. The device 10 is further stabilized by positioning the items 110 upon the horizontal portions of one (1) or more vertical retaining braces 20. The vertical retaining braces 20 are envisioned to be approximately three (3) inches tall so as to allow easy access by a user to an inner space of the cupboard 150 and convenient loading and unloading of the items 110 from the cupboard 150.

Furthermore, the tubular rails 22, 24 provide a width adjustment which allows the user to extend and retract the rails 22, 24 in a telescoping manner to span the front opening of the cupboard 150 as well as provide attachment of the tubular fasteners 35 affixed to the rails 22, 24 to the receiving fasteners correspondingly located along inner surfaces of the cupboard 150.

Figure 3:
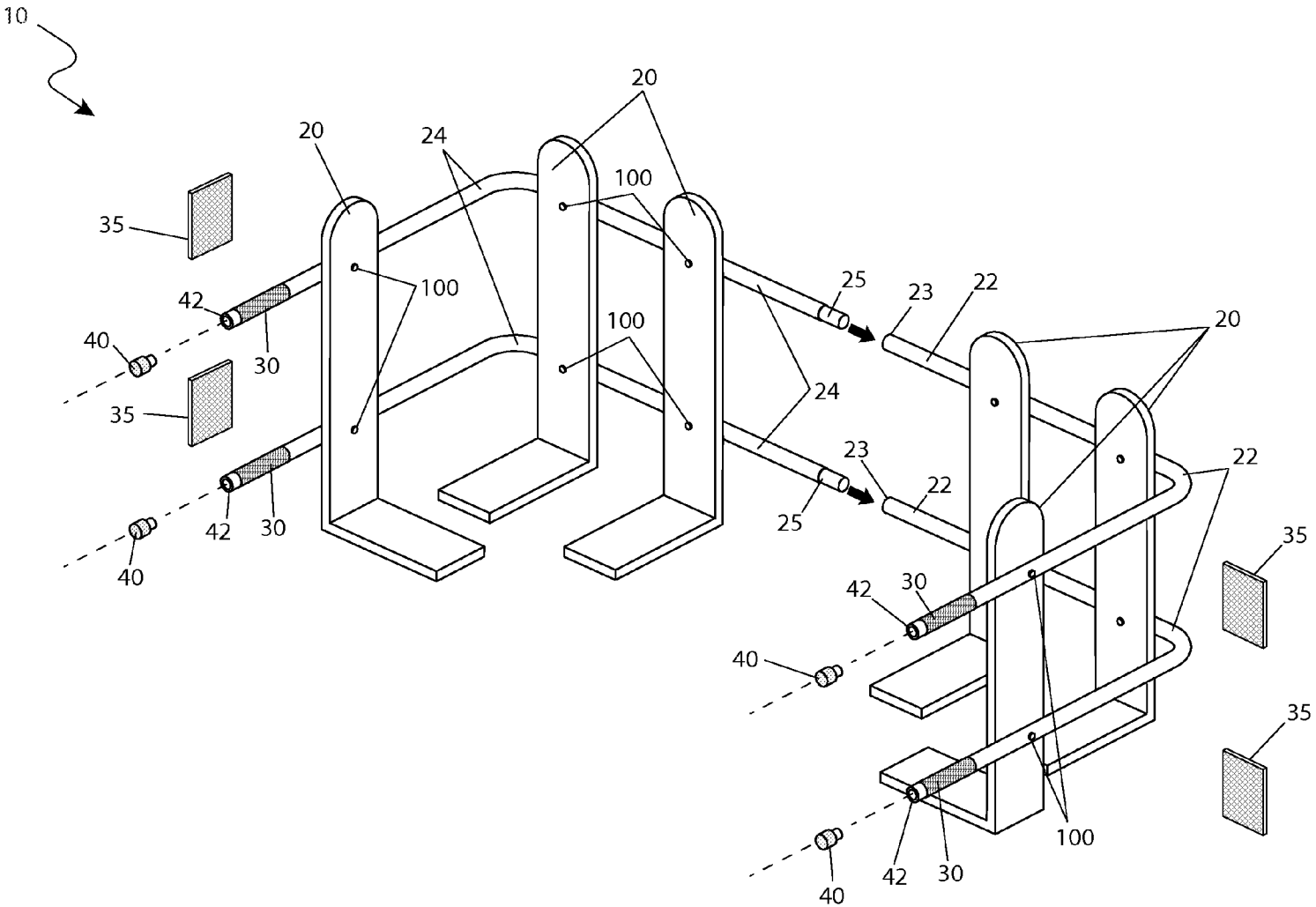
FIG. 3 is a perspective view of the adjustable retainer for shelves 10 depicting separation of first 22 and second 24 tubular rail portions, according to a preferred embodiment of the present invention; and, FIG. 4 is a section view of the first 22 and second 24 tubular rail portions taken along section line A-A of FIG. 1, according to a preferred embodiment of the present invention.
Figure 4:
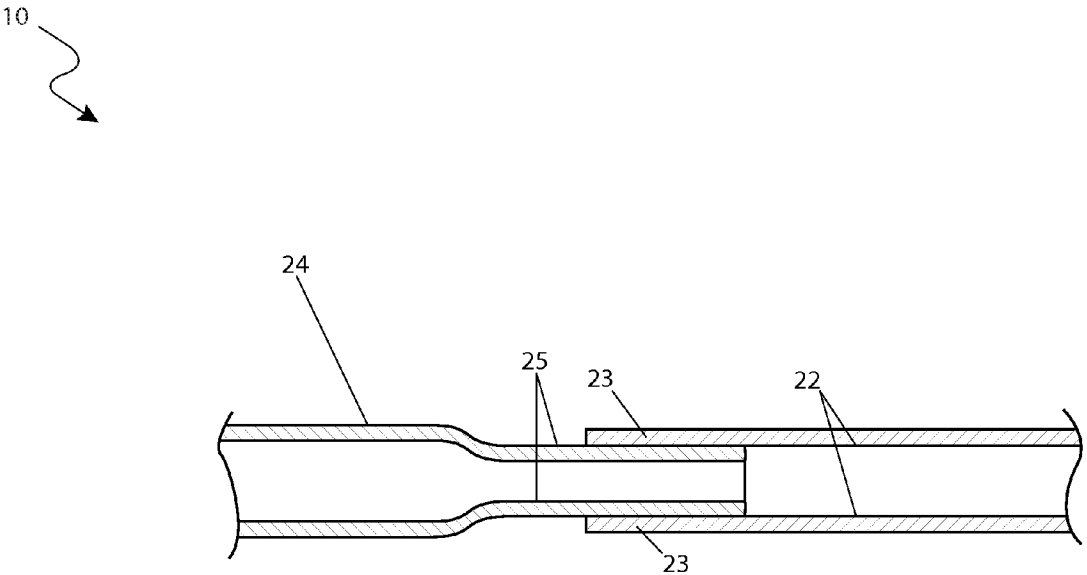

Referring now to FIGS. 3 and 4, a perspective and a section view of the device 10, depicting the interaction between the first 22 and second 24 tubular rail portions, are disclosed. The first 22 and second 24 tubular rails comprise hollow round tubes which provide an insertable telescoping connection with each other via respective integral female tubular features 23 and male tubular features 25. The female tubular feature 25 and male tubular feature 23 provide a means to vary the overall width of the device 10 allowing the user to configure the device 10 to snuggly fit the front opening portion of a particular cupboard 150. Each female tubular feature 25 and male tubular feature 23 provides a close, smoothly sliding engagement to secure a horizontal alignment and to strengthen the tubular rails 22, 24 when connected. The telescoping function of the inserted tubular features 23, 25 allows the user to select a prescribed overall width of the device 10.

The tubular rails 22, 24 further comprise respective end caps 40 which provide an aesthetic termination at opposite end positions. The end caps 40 are envisioned to be made of soft plastic and are to be tightly inserted into the hollow end portions 42 of the tubular rails 22, 24.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIGS. 1 through 3.

The method of installing and utilizing the device 10 may be achieved by performing the following steps: procuring a particular model of the device 10 having an overall width which corresponds to an opening of a cupboard 150 or other storage space into which the device 10 is to be installed; inserting the male tubular feature 25 of each second tubular rail 24 into the respective female tubular features 23 of each first tubular rail portion 22; installing hook-and-loop fasteners 35 along inner surfaces of the cupboard 150 at positions which correspond with mating hook-and-loop portions 35 affixed to the tubular rails 22, 24; placing the device 10 within a front opening of the cupboard 150 such that the front portion of the device 10 is slightly indented from the front opening, thereby allowing normal closure of door portions of the cupboard 150, if so equipped; joining the tubular fastening means 35 located upon the tubular rails 22, 24 to the tubular fastening means 35 previously installed along inner side surfaces of the cupboard 150 by spreading the fist 22 and second 24 tubular rails telescopingly apart until the tubular fastening means 35 are in contact with and secured to each other; loading various items 110 such as food stuffs, personal care items, and the like, into the cupboard 150; and, benefiting from containment and stable vehicular transporting of various items 110 within a cupboard 150 using the present invention 10.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. An adjustable retaining device for shelving, said device comprising:

a first rail section, comprising at least two elongated tubular members, each tubular member having a receiving end, a terminating end opposite said receiving end, and a generally ninety degree intermediate bend;

a second rail section insertably connected to said first rail section, comprising at least two elongated tubular members, each tubular member having an insertable end comprising an outer diameter slightly smaller than an inner diameter of said first rail tubular member receiving end, a terminating end opposite said insertable end, and a generally ninety degree intermediate bend;

a plurality of vertical braces affixed to said first rail section and said second rail section, each comprising a flat generally "L"-shaped member having a vertical leg oriented across said tubular members and a horizontal leg extending inwardly from said tubular members; and, a plurality of end caps insertable into each of said tubular member terminating ends;

wherein each of said second rail tubular member insertable ends are insertably connected to each of said first rail tubular member receiving ends;

wherein said device is width adjustable; and, wherein said device is adapted to be installed in a compartment structure defined by at least one horizontal shelf.

2. The device of claim 1, wherein said device further comprises a fastening means for removably connecting said first rail section and said second rail section to an interior of said compartment structure.

3. The device of claim 2, wherein said fastening means further comprises a tubular fastener disposed on said tubular member adjacent to each of said terminating ends; and, a plurality of receiving fasteners mounted to said interior of a compartment structure corresponding to each of said tubular fasteners.

4. The device of claim 3, wherein said fastening means further comprises communicating sections of hook-and-loop fasteners.

5. The device of claim 1, wherein said plurality of vertical braces each further comprises a flat generally "L"-shaped member having a vertical leg oriented across said first rail section and said second rail section and a horizontal leg extending inwardly from said first rail section and said second rail section.

6. The device of claim 5, wherein said device further comprises a fastening means for removably connecting said first rail section and said second rail section to an interior of said compartment structure.

7. The device of claim 6, wherein said fastening means further comprises a tubular fastener disposed on said tubular member adjacent to each of said terminating ends; and, a receiving fastener mounted to said interior of a compartment structure corresponding to each of said tubular fasteners.

8. The device of claim 7, wherein said fastening means further comprises communicating sections of hook-and-loop fasteners.

9. An adjustable retaining device for shelving, said device comprising:

a first rail section comprising at least two elongated first tubular members, each first tubular member having a receiving end, a terminating end opposite said receiving end, and a generally ninety degree intermediate bend;

a second rail section comprising at least two elongated second tubular members, each second tubular member having an insertable end, a terminating end opposite said insertable end, and a generally ninety degree intermediate bend;

a plurality of flat generally "L"-shaped braces having a vertical leg oriented across said tubular members and a horizontal leg extending inwardly from said tubular members; and, a plurality of end caps insertable into each of said tubular member terminating ends;

wherein each of said second rail tubular member insertable ends are insertably connected to each of said first rail tubular member receiving ends;

wherein said device is width adjustable; and, wherein said device is adapted to be installed in a compartment structure defined by at least one horizontal shelf and a pair of opposing vertical sidewalls.

10. The device of claim 9, wherein said device further comprises a fastening means for removably connecting said first rail section and said second rail section to an interior of said compartment structure vertical sidewalls.

11. The device of claim 10, wherein said fastening means further comprises a tubular fastener disposed on said tubular member adjacent to each of said terminating ends; and, a plurality of receiving fasteners mounted to said compartment structure vertical sidewall interior corresponding to each of said tubular fasteners.

12. The device of claim 11, wherein said tubular fasteners and receiving fasteners further comprise communicating sections of hook-and-loop fasteners.

13. The device of claim 12, wherein said second rail tubular member insertable end further comprises an outer diameter slightly smaller than an inner diameter of said first rail tubular member receiving end.

* * * * *